US005967203A

United States Patent [19]

Culver, III

[11] Patent Number: 5,967,203

[45] Date of Patent: Oct. 19, 1999

[54] DEVICE FOR COLLECTING VISCOUS FLUIDS

[76] Inventor: Jesse Locke Culver, III, 13438 Meridian Rd. N., Tallahassee, Fla. 32312-9754

[21] Appl. No.: 08/616,224

[22] Filed: Mar. 15, 1996

[51] Int. Cl.[6] ..... B65B 1/04; B65B 3/04; B67C 3/02

[52] U.S. Cl. ..... 141/106; 141/114; 141/313; 141/314; 141/331; 141/337; 141/363; 141/364

[58] Field of Search ..... 141/98, 106, 114, 141/313, 314, 331, 337–339, 363, 364, 375, 377, 326, 327; 222/108, 460; 211/74, 85; 248/94, 311.3

[56] References Cited

U.S. PATENT DOCUMENTS

| | | | |
|---|---|---|---|
| 2,071,944 | 2/1937 | Hoffman | 248/311.3 |
| 2,230,180 | 1/1941 | Collins | 141/106 |
| 2,369,982 | 2/1945 | Richards | 141/106 |
| 2,575,809 | 11/1951 | Hankins | 141/106 |
| 2,781,065 | 2/1957 | Hofacer | 141/106 |
| 4,832,095 | 5/1989 | Bonnell | 141/106 |

*Primary Examiner*—Henry J. Recla
*Assistant Examiner*—Timothy L. Maust
*Attorney, Agent, or Firm*—Carnes, Cona and Dixon

[57] ABSTRACT

A collecting device for collecting a viscous fluid comprising a base having a front panel, a back panel and an interior area located therebetween. A lower portion of the base further includes an outlet port. This outlet port is adapted to be located into a holding container. Located on the front panel and/or back panel are a plurality of apertures which extend into the interior area. A holding receptacle is secured in front of each aperture. Accordingly, utilization of the device occurs once bottles are inverted into the apertures. The holding receptacles maintain the bottles in a fixed and inverted position. Residue of the viscous fluid located within the bottle flow from the bottles to the side walls of the interior area. Gravity forces the residue to the outlet port and into the holding container. This collected material can be stored for later use.

20 Claims, 3 Drawing Sheets

DEVICE FOR COLLECTING VISCOUS FLUIDS

BACKGROUND OF THE INVENTION

1. Field of the Invention

The present invention relates generally to a device for collecting viscous fluid and more particularly to a device which is adapted to removably receive and maintain a plurality of containers for collecting the residue of the viscous substance located in the plurality of containers.

2. Description of the Prior Art

Individuals have discovered that viscous substances, such as motor oil, syrup, catsup, or the like, normally require an extremely extended period of time to adequately drain the residue from the container which stores the particular substance. With motor oil, to reduce the waste, some individuals will allow for each motor oil container to sit in the oil pan for a long period of time. Though somewhat efficient, all the residue is not drained into the oil pan. Additionally, since some vehicles require four, five, or even six quarts of oil, this method can be extremely time consuming.

For conserving material in the restaurant or catering business, many workers will take a first bottle containing a viscous substance, such as ketchup or syrup, and invert it onto a second bottle. This first bottle is left on the second bottle for an extended period of time in hopes that the viscous material will completely drain into the second bottle. Though somewhat efficient, this system does not provide for a support means for the first bottle, thereby rendering the possibility of the first bottle tipping off the second bottle and defeating this system. Additionally, this system only allows one bottle at a time to be drained.

Accordingly, efforts have been made to provide an efficient means of draining viscous substances from a plurality of containers. Once such device is disclosed in U.S. Pat. No. 4,842,095 issued to Bonnell. Bonnell discloses a device which is adapted to collect viscous fluid from a plurality of vessels including a funnel member, a plurality of vessel retainer elements disposed in the open top portion of the funnel member for holding the vessels in inverted positions, and an open-mouthed receptacle demountably attached to the bottom of the funnel member for receiving the fluid. This device does successfully retrieve the material, however, the design and configuration provides for a device which is limiting. This device fails to enable conventional vessels to be secured to the bottom, an option which is highly desirable in the restaurant field. Additionally, this device is limiting in the size vessel which can be received in the retainer elements. Vessels small or large in diameter would not adequately enable the lid of the device to maintain the vessels in an inverted position.

Hence, none of these previous efforts provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a device which is adapted to receive a plurality of vessels for retrieving the residue of the viscous material located within the plurality of vessels.

The device of the present invention can be fabricated from a recyclable material and includes a rectangularly shaped base having a front panel, a back panel and an interior area located therebetween. Located on the front panel and/or back panel are a plurality of apertures. These apertures extend into the interior area of the base. A holding receptacle is secured in front of each aperture. This will enable the mouth of the container to be received in the aperture while the holding receptacle holds and maintains the container in an inverted position.

The base further includes an upper portion and a lower portion. The upper portion includes a supporting means for supporting the base while the lower portion includes an outlet port. This outlet port can be located within a mouth of a conventional vessel. The supporting means can be a hook member or optionally can be a receiving means for enabling the receiving means to receive the ends of a conventional hanger so as to enable the base to be in a hung and upright position.

Hence, to utilize the device, the supporting means is secured to a conventional nail, hook, or the like for providing for the device to be in an upright position.

The bottles containing the residue of viscous material are inverted into the apertures of the base. The holding receptacles maintain the bottles in an inverted position. A conventional bottle to receive the residue is secured to the outlet port. The bottles are left in this position for an extended period of time.

This design and configuration will enable the fluid to drain from the bottles and into the side wall of the interior area of the base. Gravity will force the viscous material downward to the outlet port and exit into the conventional bottle. The collected material from the plurality of bottles is maintained within the conventional bottle and can be stored for later use.

Accordingly, it is an object of the present invention to provide for a device that is adapted to receive a plurality of containers for collecting the residue of viscous material located within the plurality of containers.

It is yet another object of the present invention to provide for a device which is adapted to receive and maintain any size or shape container for adequately retrieving any viscous material successfully and efficiently.

Still a further object of the present invention, to be specifically enumerated herein, is to provide a collecting device in accordance with the preceding objects and which will conform to conventional forms of manufacture, be of simple construction and easy to use so as to provide a device that would be economically feasible, long lasting and relatively trouble free in operation.

Although there have been some inventions related to a collecting device, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
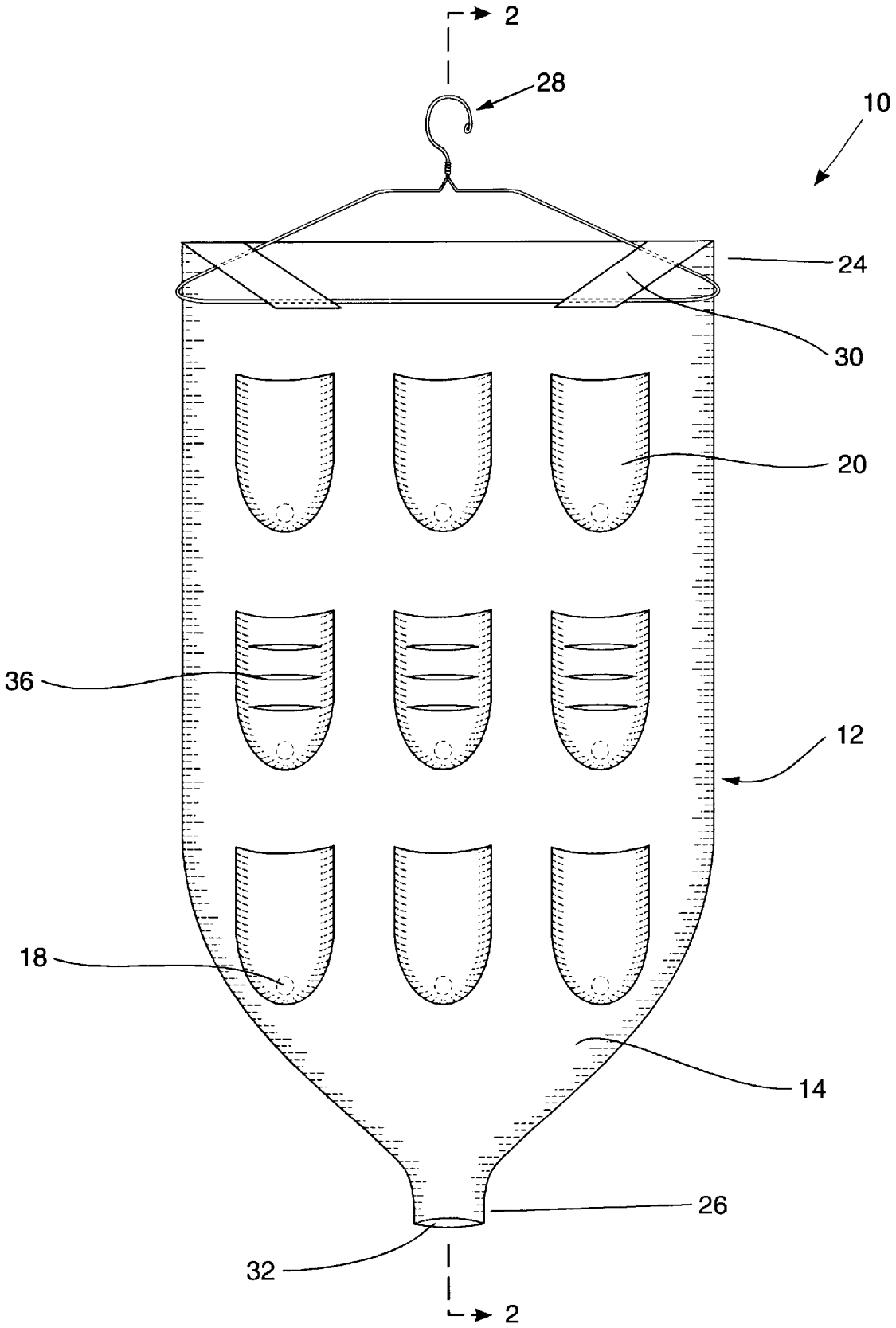
FIG. 1 is a front planar view of the collecting device of the present invention.
Figure 2:
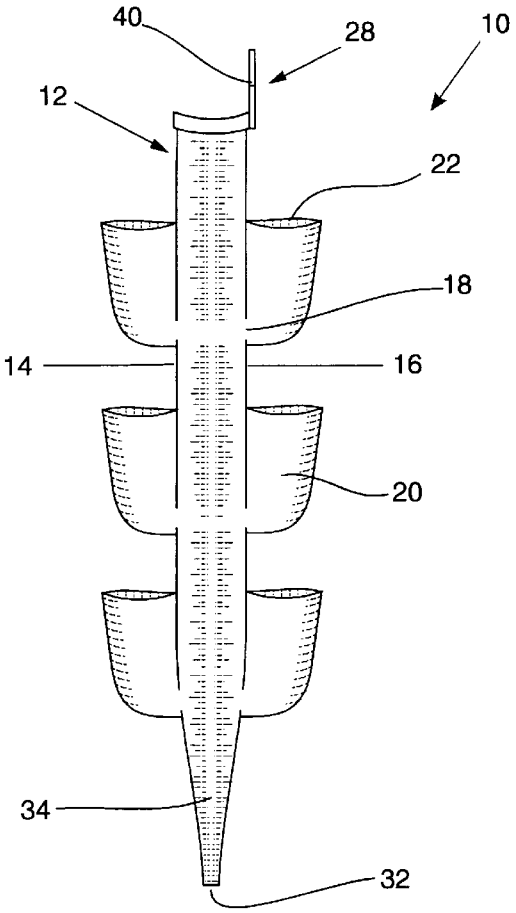
FIG. 2 is a cross sectional view of the collecting device of the present invention taken along lines 2—2 of FIG. 1.
Figure 3:
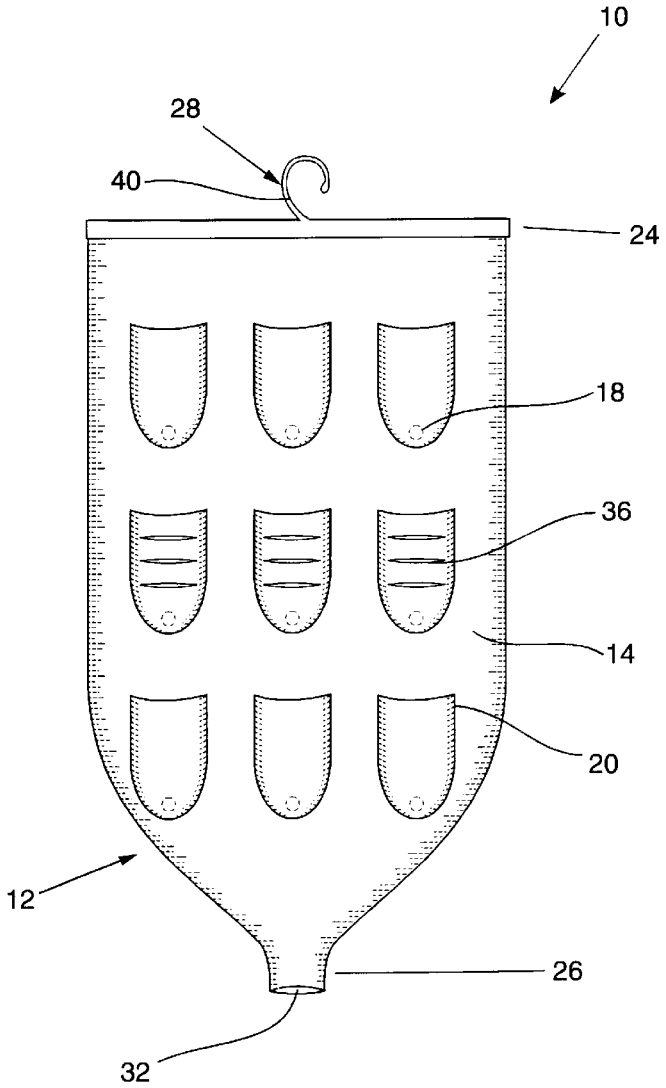
FIG. 3 is a front planar view of the collecting device of the present invention having an optional supporting means.

As seen in FIGS. 1–3, the collecting device 10 of the present invention includes a base 12. The base 12 includes a front panel 14 secured to a back panel 16. Located between the front panel 14 and back panel 16 is an interior area 34.

Extending through the front panel 14 and/or the back panel 16 and to the interior area are a plurality of apertures 18. These apertures are adapted to receive the mouth of a conventional bottle. Affixed in front of each aperture is a holding receptacle 20. This holding receptacle is adapted to maintain the conventional bottle in an inverted position and prohibits the conventional bottle from falling or dislodging from the aperture.

The holding receptacle 20 includes an opened top 22 for receiving the conventional bottle. The lower portion of the holding receptacle 20 is preferably secured to the panel or optionally can be opened. The object of the holding receptacle 20 is to prohibit the conventional bottle from disengaging from the aperture.

The holding receptacle 20 can also include a plurality of slits 36, horizontally disposed. These slits are used to enable the holding receptacle 20 to accept any size or designed bottle. Accordingly, a larger sized bottle placed within the aperture and holding receptacle will cause the slits to expand apart and allow the holding receptacle to maintain the container efficiently. Smaller sized bottles can be inserted into the holding receptacle 20 via one of the horizontally disposed slits or optionally through the open top of the holding receptacle.

The base 12 further includes a top portion 24 and a lower portion 26. The top portion 24 includes a supporting means 28. The supporting means 28 in one embodiment, as illustrated in FIG. 1, includes a receiving means 30. The receiving means 30 can be located on either the front or back panel or above the top portion. This receiving means 30 is adapted to receive and maintain a conventional hanger or the like. This will provide for the device 10 to be hung in a vertical and upright position via the hook of the conventional hanger.

As seen in FIG. 1, the receiving means comprises straps, having opposite ends. These ends are angularly attached to the front panel or back panel to provide for one end to be secured to the top portion and for the opposite end to be secured to the outer edge of the panel. This will provide for an opening or pocket to be inherently formed to allow for the receiving means to receive and maintain a conventional hanger. The conventional hanger will be the supporting means 28 for this embodiment.

Optionally, the top portion can be reconfigured to include a hook device 40, as illustrated in FIG. 2 and FIG. 3. This hook 40, centrally located on the top portion, will provide for the supporting means for the device 10. This hook will allow for the device to be in a hung and upright position.

The lower portion 26 of the device 10 is opened and decreases in size from the upper portion to provide for the lower portion to inherently form an outlet port 32. This outlet port 32 is adapted to be inserted into a retrieving means, such as a conventional bottle for enabling fluid flow from the interior area of the device and into a conventional bottle.

Accordingly, to utilize the device, if a receiving means is supplied on the device, then the supporting means 28 (such as a conventional hanger) is secured thereto. The hook of the hanger or the hook device 40 is secured to a nail, rivet, hook or the like, to provide for the device to be in an upright and vertical position. A conventional receiving receptacle, such as a bottle is situated below the base. The spout of the lower portion 26 of the base is inserted into the conventional receiving receptacle. Bottles are inserted into the open top 22 of the holding receptacle 20 to provide for the spout of the bottle to be inserted in the aperture 18. This will provide for the bottles to be in an inverted position.

Hence, the residue of the viscous material escapes the conventional inverted bottles and flows onto the side wall of the interior area. Gravity forces the viscous material downward and to the outlet port 32. From the outlet port the fluid flows into the receiving receptacle. Over an extended period of time, all residue will be relocated within the receiving receptacle to enable the fluid to be stored for later use.

Figure 4:
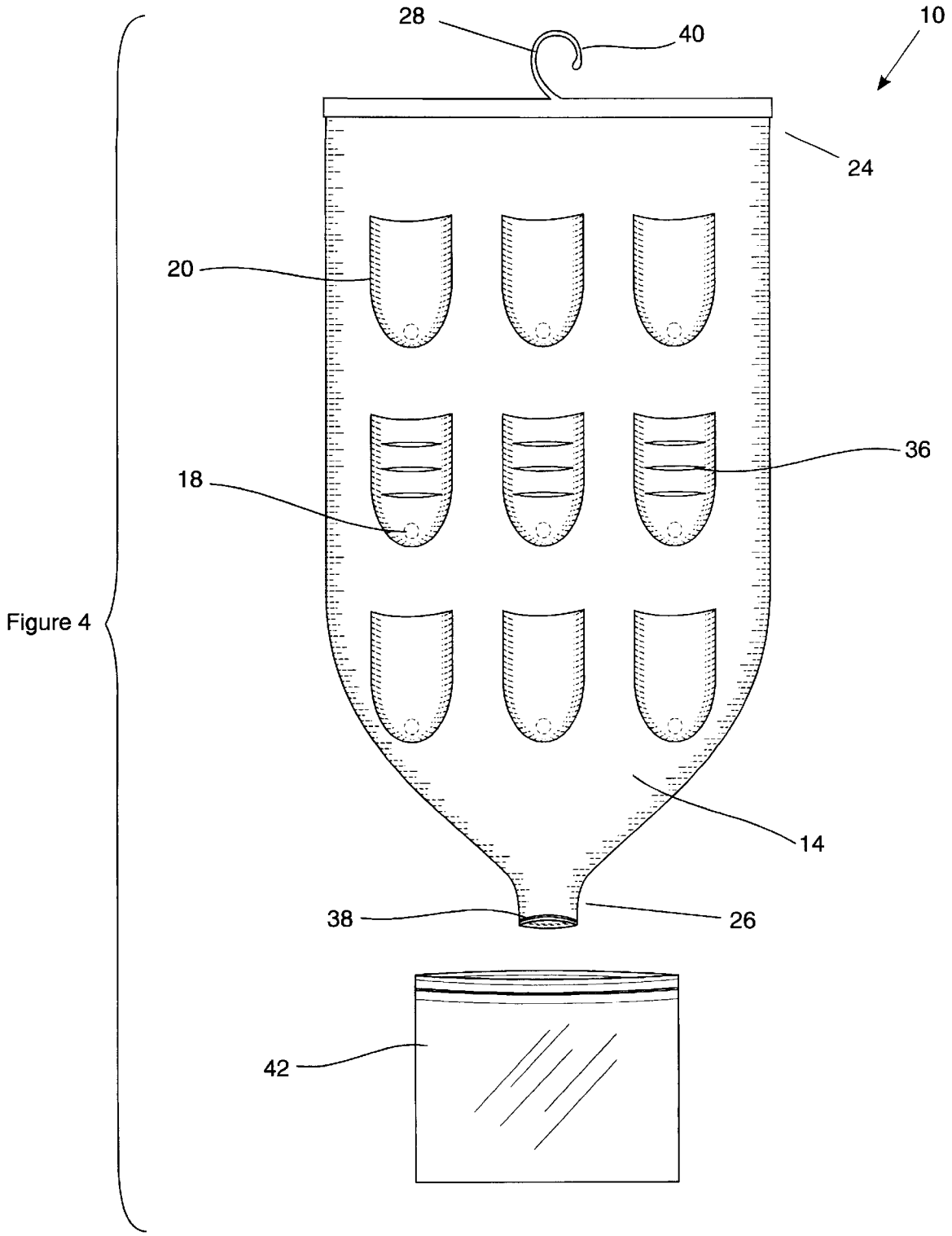
FIG. 4 is a front planar view of the collecting device of the present invention having an alternative configuration for the spout.

Alternatively, the lower portion can be altered to provide for an alternative embodiment. This alternative embodiment is illustrated in further detail in FIG. 4. As seen in this figure, the device 10 includes a lower portion 26 interlocking ridges 38 for removably attaching a conventional plastic bag 42, or the like, to the lower portion. These interlocking ridges 38 are adapted to correspond and cooperate with the interlocking ridges located on the conventional plastic bag for rendering the plastic bag to be removably engageable to the lower portion. Thereby, providing for a device which is completely biodegradable.

Utilization of this embodiment is similar as described in detail in the first embodiment and as illustrated in FIG. 1, with the exception that a conventional bag 42 is secured to the spout 32.

It is noted that the collecting device 10 can include a lid in order to protect the viscous material located within the device. The lid is illustrated in FIG. 2 (not labeled) and is adapted to be removably secured to the top portion 24 of the device 10.

The material utilized for the embodiments described above must be durable in order to withstand the weight of the containers in combination with the viscous material located within the bottle. Further still, the material is preferably a heavy weight biodegradable material, such as a plastic, or the like, thereby providing a device which is collapsible. The collecting device of the present invention can be designed for single use or for reusability.

The collecting device of the present invention will successfully conserve material for the consumer. In the oil industry, the container device will aid in saving the environment from excess waste because typically, empty oil containers are not considered recyclable. As such, consumers must throw their partially emptied containers into their trash cans/bins. This will cause these containers to be relocated into a land fill which will inherently increase the chances of oil leaking into the soil, or the like, thereby providing a situation that is potentially dangerous for the environment.

While the invention has been particularly shown and described with reference to an embodiment thereof, it will be understood by those skilled in the art that various changes in form and detail may be made without departing from the spirit and scope of the invention.

I claim:

1. A collecting device comprising:

a base having a front panel is secured to a back panel and includes an interior area located therebetween;

a plurality of apertures are located on at least one panel;

a holding receptacle is secured in front of each aperture;

an outlet port is located at a bottom portion of said base and a retrieving means is coupled to said outlet port for enabling bottles to be inverted into said plurality of apertures for permitting residue fluid from said bottles to flow from said bottles to said interior area and into said retrieving means; and said holding receptacle includes an open top and an enclosed bottom.

2. A collecting device as in claim 1 wherein said base is fabricated from a biodegradable material.

3. A collecting device as in claim 1 wherein said base includes a top portion located oppositely from said bottom portion, said top portion includes a supporting means for enabling said base to be in a hung and upright position.

4. A collecting device as in claim 3 wherein said supporting means is a hook device.

5. A collecting device as in claim 3 wherein said supporting means includes a pair of straps, oppositely located, said straps include opposite ends, a first end is secured to said top portion and said opposite end is secured to an outer edge of said base for providing an opening for receiving an end of a conventional hanger, and said conventional hanger provides for said supporting means.

6. A collecting device as in claim 1 wherein said holding receptacle further includes a plurality of slits horizontally disposed.

7. A collecting device as in claim 1 wherein said outlet port decreases in width from said base.

8. A collecting device as in claim 1 wherein said outlet port includes interlocking ridges.

9. A collecting device as in claim 1 wherein said base is collapsible.

10. A collecting device comprising:

a base having a front panel is secured to a back panel and includes an interior area located therebetween;

a plurality of apertures are located on said front panel;

a holding receptacle is secured in front of each aperture;

an outlet port is located at a bottom portion of said base and a retrieving means is coupled to said outlet port for enabling bottles to be inverted into said plurality of apertures for permitting residue fluid from said bottles to flow from said bottles to said interior area and into said retrieving means; and said holding receptacle includes an open top and an enclosed bottom.

11. A collecting device as in claim 10 wherein a plurality of apertures are located on said back panel.

12. A collecting device as in claim 10 wherein said base is fabricated from a biodegradable material.

13. A collecting device as in claim 10 wherein said base includes a top portion located oppositely from said bottom portion, said top portion includes a supporting means for enabling said base to be in a hung and upright position.

14. A collecting device as in claim 13 wherein said supporting means is a hook device.

15. A collecting device as in claim 13 wherein said supporting means includes a pair of straps, oppositely located, said straps include opposite ends, a first end is secured to said top portion and said opposite end is secured to an outer edge of said base for providing an opening for receiving an end of a conventional hanger, and said conventional hanger provides for said supporting means.

16. A collecting device as in claim 10 wherein said holding receptacle further includes a plurality of slits horizontally disposed.

17. A collecting device as in claim 10 wherein said outlet port decreases in width from said base.

18. A collecting device as in claim 10 wherein said outlet port includes interlocking ridges.

19. A collecting device as in claim 10 wherein said base is collapsible.

20. A collecting device comprising:

a base having a front panel is secured to a back panel and includes an interior area located therebetween;

a plurality of apertures are located on at least one panel;

a holding receptacle is secured in front of each aperture;

an outlet port is located at a bottom portion of said base and a retrieving means is coupled to said outlet port for enabling bottles to be inverted into said plurality of apertures for permitting residue fluid from said bottles to flow from said bottles to said interior area and into said retrieving means; and said base is collapsible.

* * * * *